United States Patent [19]

Cunningham

[11] 4,433,733

[45] Feb. 28, 1984

[54] OIL STORAGE TANK EXTINGUISHER

[76] Inventor: Byron H. Cunningham, 1661 Las Piedras Ct., Los Gatos, Calif. 95030

[21] Appl. No.: 329,183

[22] Filed: Dec. 10, 1981

[51] Int. Cl.[3] ..... A62C 1/18

[52] U.S. Cl. ..... 169/49; 169/67; 169/69

[58] Field of Search ..... 169/48, 49, 66, 67, 169/68, 69, 54, 70, 5, 16

[56] References Cited

U.S. PATENT DOCUMENTS

| | | | |
|---|---|---|---|
| 1,520,288 | 12/1924 | Featherstone | 169/49 |
| 1,599,826 | 9/1926 | Lienhard et al. | 169/49 |
| 1,679,243 | 7/1928 | Fasul | 169/49 |
| 3,724,555 | 4/1973 | Chiasson et al. | 169/49 |
| 3,730,278 | 5/1973 | Roy | 169/49 |

*Primary Examiner*—Joseph J. Rolla
*Assistant Examiner*—Charles C. Compton
*Attorney, Agent, or Firm*—Robert G. Slick

[57] ABSTRACT

A snuffer is provided for putting out fires in oil tanks or oil wells which consists of a framework for maintaining an asbestos or the like covering, forming a cap which can be lowered over the fire. A fire retardant fluid may be injected within the snuffer.

5 Claims, 3 Drawing Figures

OIL STORAGE TANK EXTINGUISHER

SUMMARY OF THE INVENTION

Oil well fires and fires in oil tanks have always been a serious problem and no satisfactory means have been provided for putting out such fires. Although snuffer type structures have been proposed in the past, these have been so heavy and unwieldly that they have provided no satisfactory solution to the problem.

In accordance with the present invention, a snuffer is provided which is of relatively light construction so that it can be easily placed over a burning oil tank or the like. Preferably the snuffer includes means for introducing a fire retardant fluid within the snuffer.

The snuffer of the present invention can also be provided with a ground flap which further aids in sealing off the fire.

Additionally, in accordance with one embodiment of the present invention, guide means are provided so that the snuffer is guided over a burning tank.

In accordance with still another embodiment of the present invention, relief means is provided so that there will not be an excessive buildup of a fire retardant liquid within the snuffer.

Various other objects and features of the invention will be brought out in the balance of the application.

DESCRIPTION OF THE PREFERRED EMBODIMENTS

Figure 1:
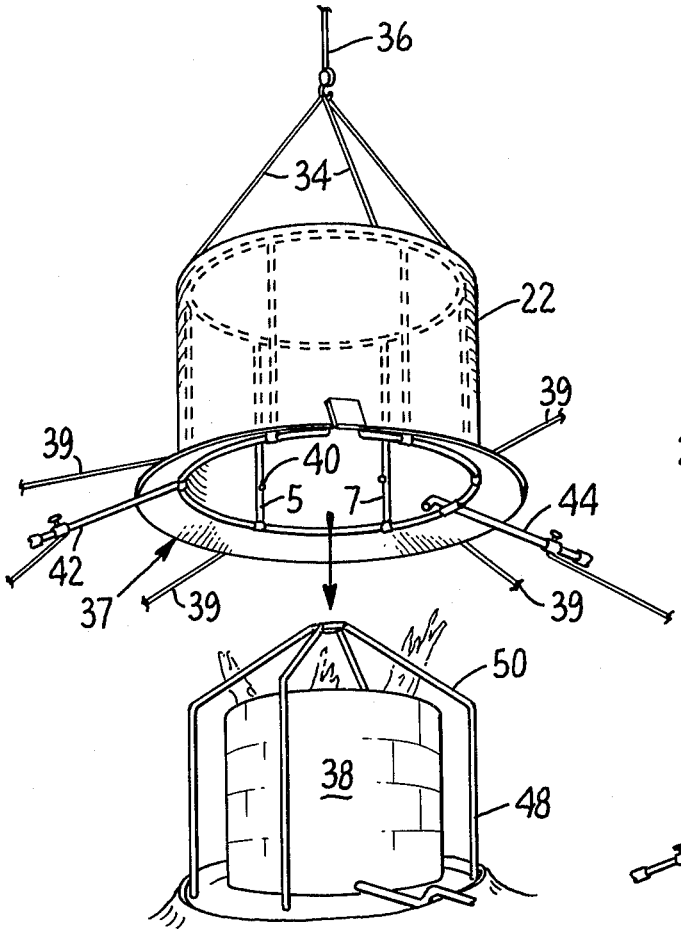
FIG. 1 is an exploded perspective view of a snuffer embodying the present invention and an oil tank.
Figure 2:
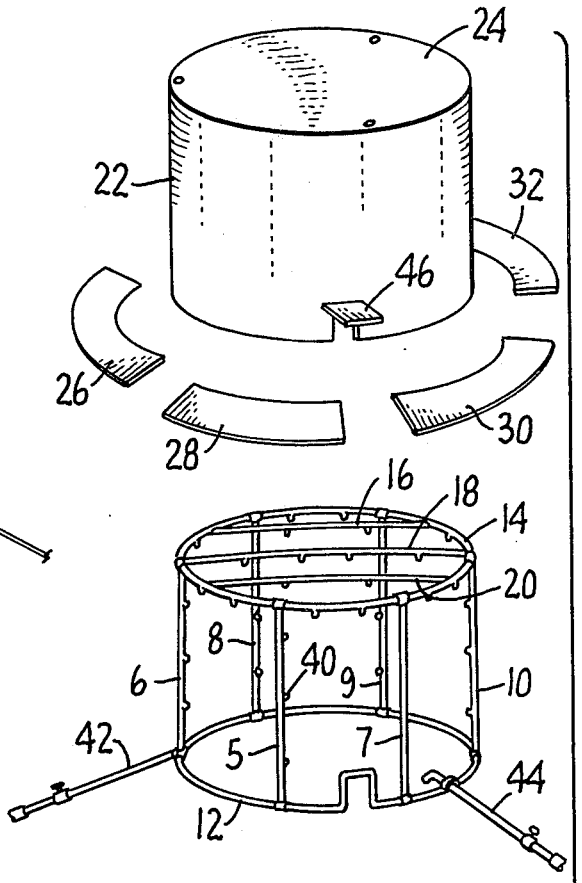
FIG. 2 is an exploded perspective view showing the framework and covering of a snuffer involving the present invention.
Figure 3:
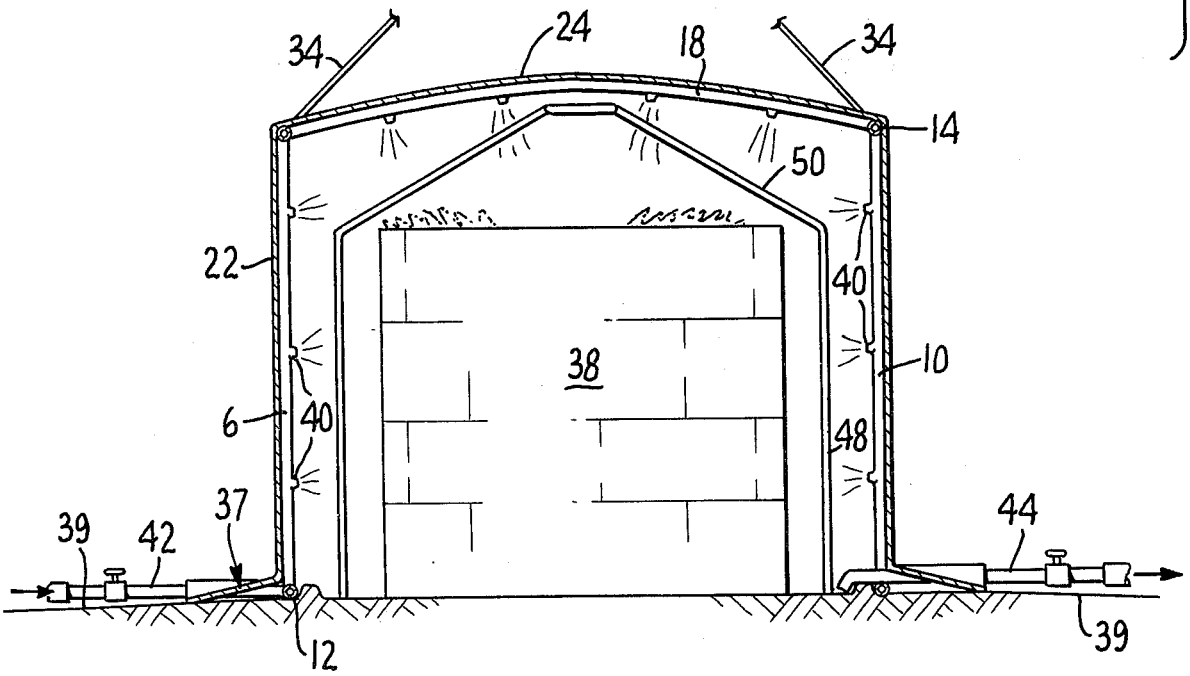
FIG. 3 is an enlarged sectional view of a snuffer embodying the invention.

Referring now to the drawings by reference characters, the device of the present invention includes a frame having vertical members 5, 6, 7, 8, 9 and 10 which are joined together at the bottom by a circular frame member 12 and at the top by a similar frame member 14. In addition, the frame can have a number of cross members at the top such as those designated 16, 18 and 20. The frame must be able to withstand fire for a sufficient period of time to extinguish the fire and is covered by a flexible material such as asbestos having cylindrical side walls 22 and a top 24 but being open at the bottom. In addition, a plurality of flaps 26, 28, 30 and 32 are provided. These members are all joined together to effectively form a single flap 37 as is shown in FIG. 1 and should extend 12 to 15 feet out in all directions. Guy lines 39 hold the flap extended as the snuffer is lowered over a fire. These should be at least four in number. The guy lines hold the flaps away from the bottom so that the flaps will not become trapped under the snuffer and also hold the flap along the ground.

In the simplest embodiment of the invention, the device acts merely as a snuffer. When used in this manner, the snuffer is picked up utilizing cables as at 34 and 36 and placed over a burning oil tank 38. The snuffer can be placed utilizing a helicopter, crane, aerial tramway or the like. Thus, in this simplest embodiment of the invention, the device acts merely as a snuffer, cutting off oxygen to the fire. The effectiveness of the device can be enhanced to shoveling mud or a similar material over the flap 37 after the device is in place.

In accordance with a preferred embodiment of my invention, the vertical members designated 5, 6, 7, 8, 9 and 10 as well as the top members designated 14, 16, 18 and 20 are provided with a plurality of nozzles such as the one designated 40. These members are all tubular and serve as pipes to convey a fire retardant fluid which is introduced through a line 42. Thus, the effectiveness of the device is further enhanced by the ability of introducing a fire retardant fluid.

If a liquid extinguisher, such as water, is employed, it tends to build up inside the chamber of my snuffer so that I provide a relief pipe 44 which extends into the chamber through a flap 46. Thus, if there is an excessive build up of liquid within the chamber, it can be drawn off through line 46, assuming that caution is used so that a seal is maintained at the bottom, which prevents the introduction of oxygen.

In accordance with another embodiment of my invention, the oil tank or structure which is to be protected is provided with a series of guides 48 which extend down the sides and around the top of the tank with inwardly directed top members 50. The conical form of top members 50 helps position the snuffer as it is lowered. The side members maintain the proper positioning.

Many oil storage tanks have steps which extend out at an angle from the tanks and such tanks should be modified to provide a spiral stairway closely following the contour of the tank in order that the operation of the snuffer cannot be inhibited. Also, any pipes which extend out of the storage tanks above the ground level should be modified to conform to the shape of the tank or placed at ground level.

The snuffer of the present invention can also serve to protect a tank which is not on fire from a nearby fire.

The structure of the present invention can also be used to put out other fires such as a fire in a drilling rig. Of course, such a rig would not be provided with any guide members but rig debris should be pulled away from the oil well fire and guide lines can be used to help place the unit over the fire. Again, the primary basis is to prevent oxygen from reaching the fire and also water or fire retardant fluid can be introduced. Additionally, the relief tube 44 provides a means for removing oil from the burning site, reducing the amount of material which can burn.

Many variations can be made of the exact structure shown without departing from the spirit of this invention. For instance, the structure is shown with six uprights but a larger or smaller number might be used. Similarly, the structure is shown as a cylinder but it could easily be made as a rectangle or square, particularly if the device might be used with a horizontal tank rather than the vertical tank illustrated.

I claim:

1. A fire extinguishing and protective device for an oil tank or the like comprising in combination:

a. a light framework forming a chamber having a closed top and closed sides and an open bottom, said chamber being somewhat larger than a fire source, b. a flexible, fireproof material covering the sides and top of said chamber, c. flexible flaps around the bottom of the sides, d. means for lifting and placing the chamber device over a source of fire and guying means to aid in placing the device and to maintain said flaps in a horizontal position, and means for lowering said chamber over the top and sides of the fire source to snuff out the fire.

2. The device of claim 1 wherein the framework is of tubular metal and the covering is of asbestos.

3. The device of claim 1 having means for injecting a fire retardant fluid within the chamber.

4. The device of claim 1 wherein said flaps have guying means to aid in placing the device and to maintain said flaps in a horizontal position.

5. The device of claim 1 wherein the fire extinguishing device and the tank on which the device is used have a plurality of mating spaced guide means situated around the tank to guide the fire extinguishing device into place over the tank and over the guide means.

* * * * *